US008553924B2

(12) United States Patent
Sumiyama et al.

(10) Patent No.: US 8,553,924 B2
(45) Date of Patent: Oct. 8, 2013

(54) SPEAKER, SPEAKER DEVICE USING THE SAME AND ELECTRONIC APPARATUS AND VEHICLE USING THE SPEAKER

(75) Inventors: Masahide Sumiyama, Mie (JP); Satoshi Koura, Mie (JP); Yoshimichi Kajihara, Osaka (JP); Koji Sano, Mie (JP); Kazuki Honda, Mie (JP); Satoshi Itoh, Mie (JP); Shuji Saiki, Nara (JP); Toshiyuki Matsumura, Osaka (JP); Shinya Mizone, Mie (JP)

(73) Assignee: Panasonic Corporation, Osaka (JP)

( * ) Notice: Subject to any disclaimer, the term of this patent is extended or adjusted under 35 U.S.C. 154(b) by 721 days.

(21) Appl. No.: 11/816,174

(22) PCT Filed: Jun. 11, 2007

(86) PCT No.: PCT/JP2007/061705

§ 371 (c)(1),
(2), (4) Date: Aug. 14, 2007

(87) PCT Pub. No.: WO2007/117045

PCT Pub. Date: Oct. 18, 2007

(65) Prior Publication Data

US 2010/0150389 A1 Jun. 17, 2010

(30) Foreign Application Priority Data

Jun. 21, 2006 (JP) ..... 2006-171108
Jun. 23, 2006 (JP) ..... 2006-173331

(51) Int. Cl.
*H04R 1/02* (2006.01)

(52) U.S. Cl.
USPC ..... 381/386

(58) Field of Classification Search
USPC ..... 381/386–395, 346
See application file for complete search history.

(56) References Cited

U.S. PATENT DOCUMENTS

| | | | | |
|---|---|---|---|---|
| 2,429,470 | A * | 10/1947 | Knowles | 381/396 |
| 4,101,736 | A | 7/1978 | Czerwinski | |
| 4,439,644 | A * | 3/1984 | Bruney, III | 181/151 |
| 5,903,658 | A * | 5/1999 | Okazaki et al. | 381/428 |
| 6,173,065 | B1 * | 1/2001 | Lin | 381/398 |

(Continued)

FOREIGN PATENT DOCUMENTS

| | | |
|---|---|---|
| CN | 2618395 Y | 5/2004 |
| JP | 53-76820 | 6/1978 |

(Continued)

OTHER PUBLICATIONS

Chinese Office action dated Sep. 13, 2010.

(Continued)

*Primary Examiner* — Fernando L Toledo
*Assistant Examiner* — Neil Prasad
(74) *Attorney, Agent, or Firm* — Pearne & Gordon LLP

(57) ABSTRACT

According to the present invention, there is provided a speaker for use in audio/video apparatuses and a small-sized speaker device capable of realizing preferable reproduction a bass sounds. In order to attain this, in the present invention, a pressure adjusting body is coupled to a portion of a magnetic circuit or a frame, which is a component of a speaker unit, to constitute the speaker unit. The speaker unit is mounted to a small-sized cabinet to constitute a speaker device, which enables realization of preferable reproduction of bass sounds.

19 Claims, 11 Drawing Sheets

(56) References Cited

U.S. PATENT DOCUMENTS

| | | | | |
|---|---|---|---|---|
| 6,338,395 | B1 * | 1/2002 | Setiabudi et al. | 181/151 |
| 6,871,724 | B2 * | 3/2005 | Hachiya et al. | 181/169 |
| 7,149,323 | B2 * | 12/2006 | Yamagishi | 381/415 |
| 7,974,423 | B2 * | 7/2011 | Matsumura et al. | 381/166 |
| 2003/0215109 | A1 * | 11/2003 | Kosuda | 381/412 |
| 2005/0152573 | A1 * | 7/2005 | Suzuki | 381/412 |
| 2007/0127760 | A1 * | 6/2007 | Saiki et al. | 381/351 |
| 2007/0195982 | A1 | 8/2007 | Saiki et al. | |
| 2007/0286449 | A1 | 12/2007 | Matsumura et al. | |

FOREIGN PATENT DOCUMENTS

| | | | |
|---|---|---|---|
| JP | 54-036919 | | 3/1979 |
| JP | 54-108025 | | 7/1979 |
| JP | 55/150579 | | 10/1980 |
| JP | 56-102191 | | 8/1981 |
| JP | 57/72680 | | 5/1982 |
| JP | 60-500645 | | 5/1985 |
| JP | 2005-294887 | | 10/2005 |
| JP | 2005-294887 | A | 10/2005 |
| WO | 2006/022199 | | 3/2006 |
| WO | 2006/022199 | A1 | 3/2006 |
| WO | 2006-022199 | A1 | 3/2006 |
| WO | 2006/035564 | | 4/2006 |
| WO | 2006/035564 | A1 | 4/2006 |
| WO | 2006-035564 | A1 | 4/2006 |

OTHER PUBLICATIONS

J.R.Wright, The Virtual Loudspeaker Cabinet, Journal of the Audio Engineering Society, Audio Engineering Society, New York, NY, US, vol. 51, No. 4, Apr. 1, 2003, pp. 244-247, XP001177694, ISSN: 1549-4950.

European Search Report for Application No. 07744997.3-2225/1944999 PCT/JP2007061705.

* cited by examiner

SPEAKER, SPEAKER DEVICE USING THE SAME AND ELECTRONIC APPARATUS AND VEHICLE USING THE SPEAKER

TECHNICAL FIELD

The present invention relates to a speaker for use in various types of audio equipment and information communication apparatuses, a speaker device, an electronic apparatus and a device and, more particularly, relates to a speaker capable of increasing the sound pressure level and realizing reproduction of bass sounds with a small speaker cabinet.

BACKGROUND ART

Recently, in the audio equipment market, there has been a trend that the function of high-quality reproduction is essential, with the wide spread use of digital audio equipment represented by DVD apparatuses.

Further, in the field of communication represented by cellular phones, there have been strong demands for reinforcement of functions size reduction and the function of high-quality reproduction.

On the other hand, in the housing conditions and the environment surrounding automobiles, there has been a demanding requirement for reduction in occupying spaces and energy consumption.

As speakers and speaker devices capable of satisfying those demands, there is a need for development of speakers and speaker devices capable of preferably reproducing deep bass sounds while having small sizes.

Against the background described above, a conventional technique will be described with reference to FIG. 15.

FIG. 15 is a cross-sectional view showing a conventional speaker device.

As illustrated in FIG. 15, speaker device 54 is constituted by cabinet 51, unit 52 mounted to cabinet 51, and pressure adjusting body 53 placed within cabinet 51.

With speaker device 54, it is difficult to reproduce bass sounds preferably due to the influence of the acoustic stiffness exhibited by the cavity of cabinet 51, since cabinet 51 has a small size.

Thus, as one means for overcoming the problem of the limit of reproduction of bass sounds which is determined by the capacity of the cabinet, in order to enable preferable reproduction of bass sounds with small-sized speaker device 54, there is placed within cabinet 51, pressure adjusting body 53, which is typified by activated carbon and the like.

Next, the operations of speaker device 54 will be described.

When electric signals are applied to speaker unit 52, this will change the pressure within cabinet 51, thereby changing the pressure in the cavity within which pressure adjusting body 53 typified by activated carbon and the like is placed.

Along with this pressure change, air molecules are absorbed by pressure adjusting body 53 or released from pressure adjusting body 53, thereby suppressing the pressure fluctuation within cabinet 51.

As described above, in conventional speaker device 54, cabinet 51 operates equivalently to a cabinet having a large capacity. Further, even though the cabinet has a small size, it is possible to reproduce bass sounds as if speaker unit 52 were mounted in a large-sized cabinet.

Further, as background art information relating to the present invention, there has been known Patent Document 1, for example.

However, conventional speaker device 54 requires placement of pressure adjusting body 53 typified by activated carbon and the like within cabinet 51, in order to realize preferable reproduction of bass sounds.

This has caused the problem of great increase in costs including the cost for pressure adjusting body itself 53 typified by activated carbon, the physical distribution cost for pressure adjusting body 53, the production cost for placing and coupling pressure adjusting body 53 inside of cabinet 51 and also including the cost for processing cabinet 51 and pressure adjusting body 53 in a case where there is a need for working upon the inside of cabinet 51.

[Patent Document 1] Unexamined Japanese Patent Publication No. 60-500645

DISCLOSURE OF THE INVENTION

According to the present invention, there is provided an excellent speaker unit capable of overcoming the foregoing problems and suppressing the increase in the cost of a speaker device including a pressure adjusting body typified by activated carbon and the like.

In order to attain this, a speaker unit according to the present invention is constituted by a magnetic circuit, a frame coupled to the magnetic circuit, a vibration plate coupled to an outer peripheral portion of the frame, a voice coil which is coupled to the vibration plate and also is partially placed in a magnetic gap in the magnetic circuit and a pressure adjusting body coupled to the frame.

As described above, according to the present invention, the speaker unit is constructed by coupling the pressure adjusting body to a portion of a component of the speaker unit.

Further, the coupling of the pressure adjusting body, the coupling between the vibration plate and the voice coil, the coupling between the vibration plate and the frame and the like are achieved through adhesion using an adhesive agent and the like. The adhesive agent and the like may be a common adhesive agent and will not be illustrated and described in detail. Further, the coupling between them are not limited to coupling through adhesion using an adhesive agent and the like, but can be achieved through screwing or other methods.

With the above structure, the pressure adjusting body typified by activated carbon, is already coupled to the speaker unit, without being individually mounted thereto during the fabrication, of the speaker device, which can suppress the increase of extra cost along with the costs for physical distribution and coupling of the pressure adjusting body in fabricating the speaker device.

Further, since the pressure adjusting body is coupled to the speaker unit, the pressure adjusting both is inevitably placed inside or near the speaker unit, which enables reproduction of bass sounds more preferably and efficiently, in comparison with the case where the pressure adjusting body is placed at a position remote from the speaker unit within the cabinet.

Further, the pressure adjusting body is coupled to the magnetic circuit in the speaker unit, which is a heat producing component, or to the frame which exists near the magnetic circuit. Accordingly, since the pressure adjusting body, which is generally prone to degrade in the performance due to humidity, is coupled inside or near the speaker unit which is heated to a higher temperature, it is possible to suppress the absorption of humidity into the pressure adjusting body, thereby preventing the degradation of the performance.

As described above, with the present invention, it is possible to realize preferable reproduction of bass sounds, while suppressing the increase in the cost, even with a small-sized speaker device.

Further, it is possible to realize a countermeasure against the absorption of moisture into the pressure adjusting body, thereby realizing improvement of the quality and reliability thereof.

Figure 1:
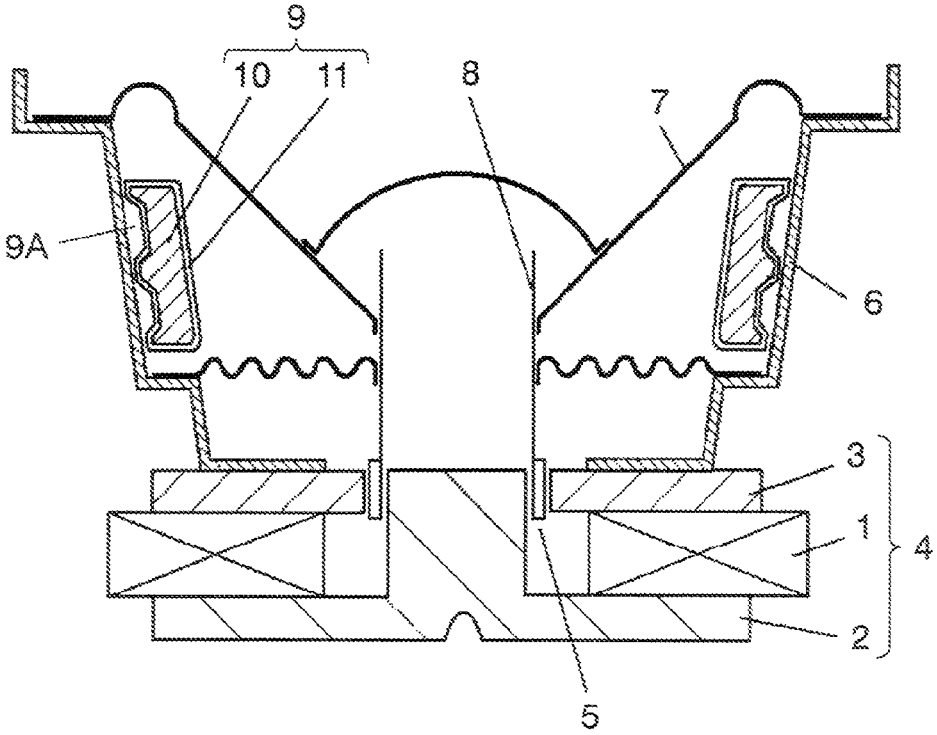
FIG. 1 is a cross-sectional view of a speaker according to a first embodiment of the present invention.

| REFERENCE MARKS IN THE DRAWINGS | |
|---|---|
| 1 | magnet |
| 2 | lower plate |
| 2A | center pole |
| 2B, 4A | hole |
| 3 | upper plate |
| 4 | magnetic circuit |
| 5 | magnetic gap |
| 6 | frame |
| 6A | air-flow hole |
| 7 | vibration plate |
| 8 | voice coil |
| 9 | pressure adjusting body |
| 9A | gap |
| 10 | pressure adjusting member |

-continued

| REFERENCE MARKS IN THE DRAWINGS | |
|---|---|
| 11 | housing portion |
| 12 | sealing case |
| 13 | dust cap |
| 20 | lower magnet |
| 21 | upper magnet |
| 22A | lower yoke |
| 22B | upper yoke |
| 23 | plate |
| 24 | magnetic circuit |
| 25 | magnetic gap |
| 26A | lower frame |
| 26B | upper frame |
| 27 | vibration plate |
| 28 | voice coil |
| 29 | fibre-type activated carbon |
| 30 | protector |
| 31 | terminal |
| 40 | speaker |
| 41 | cabinet |
| 42 | amplifier |
| 43 | player |
| 44 | audio mini composite system |
| 45 | automobile |
| 46 | cellular phone main body |
| 47 | sound-releasing hole |
| 51 | cabinet |
| 52 | speaker unit |
| 53 | pressure adjusting body |
| 54 | speaker device |

PREFERRED EMBODIMENTS FOR CARRYING OUT OF THE INVENTION

Hereinafter, embodiments of the present invention will be described with reference to the drawings.

(First Embodiment)

FIG. 1 illustrates a cross-sectional view of a speaker according to a first embodiment of the present invention.

As illustrated in FIG. 1, the speaker is constituted by magnetic circuit 4 which is constituted by lower plate 2, magnet 1 coupled to this lower plate 2 and upper plate 3 coupled to magnet 1 at its side opposite from lower plate 2, frame 6 coupled to magnetic circuit 4, vibration plate 7 coupled to an outer peripheral portion of frame 6, voice coil 8 which is coupled to vibration plate 7 and also is partially placed within magnetic gap 5 in magnetic circuit 4, and pressure adjusting body 9 coupled to frame 6. This speaker is also referred to as a speaker unit.

In this case, there is exemplified a case where pressure adjusting body 9 is coupled to the inner side of frame 6. Further, frame 6 and pressure adjusting body 9 are coupled to each other with gap 9A provided between their coupling surfaces.

With the above structure, pressure adjusting body 9 is already coupled to the speaker unit, which can suppress the increase in extra cost along with the costs for physical distribution and coupling of pressure adjusting body 9 in manufacturing the speaker device.

Further, since pressure adjusting body 9 is coupled to the speaker unit, pressure adjusting body 9 is placed inside or near the speaker unit, which enables increasing of the sound pressure level and reproduction of bass sounds efficiently and preferably, in comparison with the case where pressure adjusting body 9 is placed at a position remote from the speaker unit within the cabinet.

Further, since frame 6 and pressure adjusting body 9 are coupled to each other with gap 9A provided between their coupling surfaces, it is possible to enhance the air flow therethrough to efficiently utilize pressure adjusting body 9, thereby enabling increasing of the sound pressure level and reproduction of bass sounds efficiently and preferably.

Further, pressure adjusting body 9 is coupled to the frame 6 which exists near magnetic circuit 4 in the speaker unit, which is a heat-producing member. Accordingly, since pressure adjusting body 9, which is generally prone to degrade in the performance due to humidity, is coupled inside or near the speaker unit in which the temperature rises, it is possible to suppress the absorption of humidity into pressure adjusting body 9, thereby preventing the degradation of the performance.

Therefore, according to the present invention, it is possible to realize preferable reproduction of bass sounds even with a small-sized speaker device, while suppressing the increase in the cost.

Further, it is possible to realize a countermeasure against the absorption of humidity into pressure adjusting body 9, thereby realizing improvement of the quality and reliability thereof.

In this case, pressure adjusting body 9 is constituted by pressure adjusting member 10 and housing portion 11 for housing pressure adjusting member 10, wherein activated carbon is used as pressure adjusting member 10.

Further, pressure adjusting member 10 can be made of any material which contains activated carbon as well as activated carbon, and such a material containing, activated carbon enables realization of preferable reproduction of bass sounds.

Further, housing portion 11 can be made of a material having air permeability such as an unwoven cloth, which enables preferable reproduction of bass sounds.

On the other hand, when the speaker is expected to be used at a humid place, the housing portion 11 can be effectively made of a material having no air permeability, instead of a material having air permeability, in order to increase the quality and the reliability.

This is for preventing reduction of the low-frequency-range expansion effect due to the intrusion of water into fine holes of pressure adjusting member 10, which is typified by activated carbon.

Figure 2:
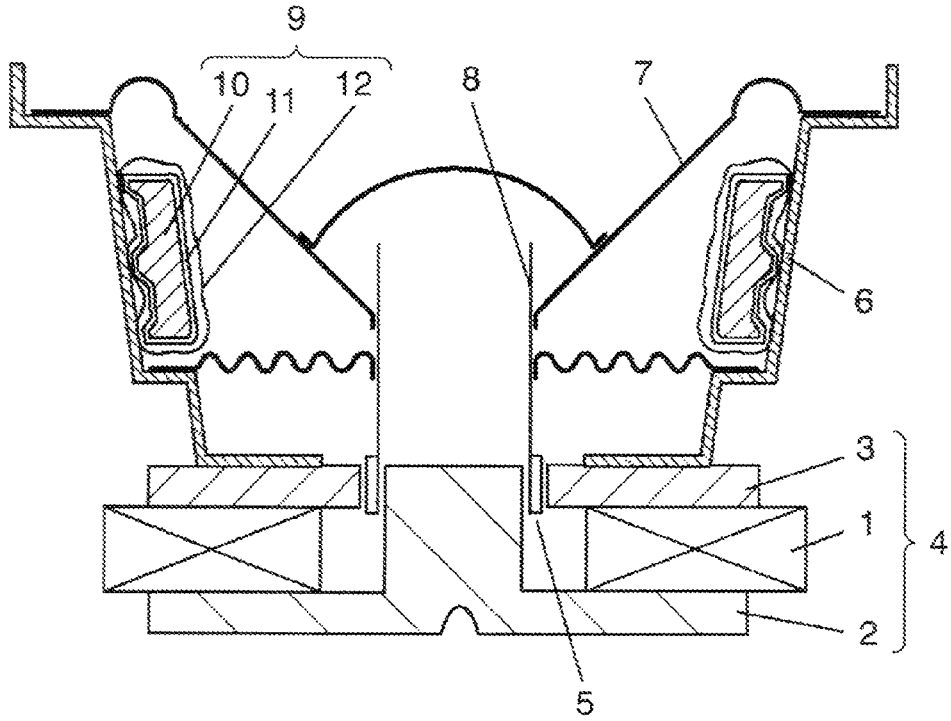
FIG. 2 is a cross-sectional view of a second exemplary speaker according to the first embodiment of the present invention.

FIG. 2 is a cross-sectional view of a second exemplary speaker according to the first embodiment of the present invention. The same components as those of FIG. 1 are designated by the same reference numerals and will not be redundantly described.

As illustrated in FIG. 2, pressure adjusting body 9 can be structured to be covered with sealing case 12 having high flexibility. This is also effective to prevent the reduction of the lower-frequency-range expansion effect due to the intrusion of water into the fine holes of pressure adjusting member 10.

Next, there will be described the portion for coupling pressure adjusting body 9.

While there has been described an embodiment in which pressure adjusting body 9 is coupled to the inner side of frame 6, the present invention is not limited to this embodiment, and there is no limitation on the portion to which pressure adjusting body 9 is coupled, provided that pressure adjusting body 9 is coupled to frame 6.

Figure 3:
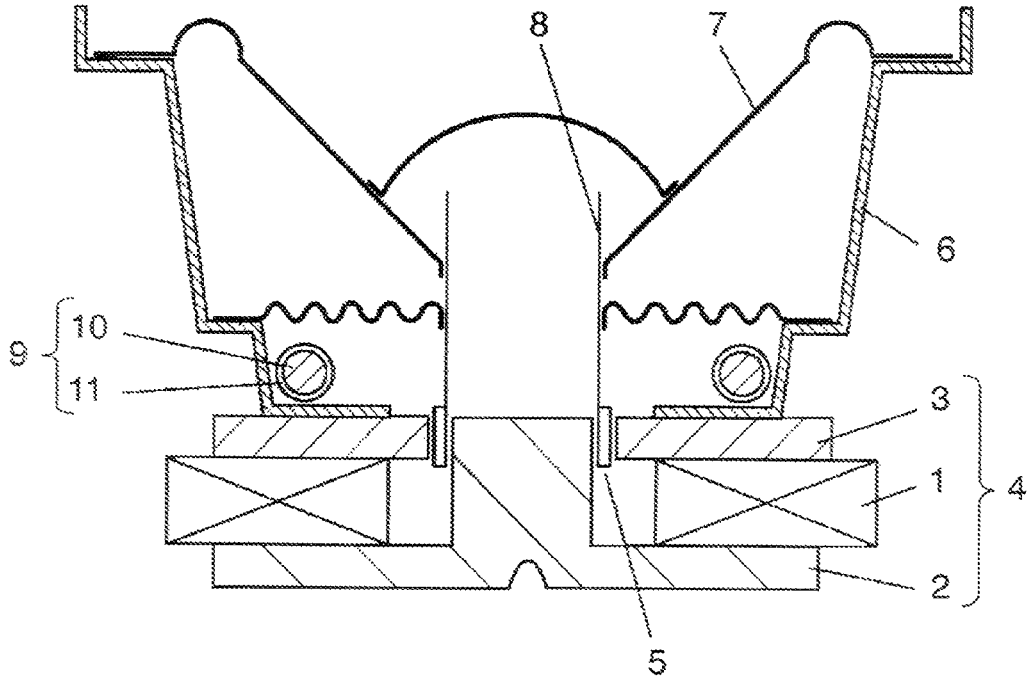
FIG. 3 is a cross-sectional view of a third exemplary speaker according to the first embodiment of the present invention.

FIG. 3 is a cross-sectional view of a third exemplary speaker according to the first embodiment of the present invention. The same components as those of FIGS. 1 and 2 are designated by the same reference numerals and will not be redundantly described.

As illustrated in FIG. 3, pressure adjusting body 9 can be coupled to frame 6 at its side opposite from the surface coupled to magnetic circuit 4.

With this structure, pressure adjusting body 9 is coupled closer to magnetic circuit 4 which is a heat producing member. Accordingly, since pressure adjusting body 9 which is prone to degrade in its performance due to humidity is coupled to a portion which is heated to a high temperature, it is possible to suppress the absorption o humidity into pressure adjusting body 9, thereby preventing the degradation of the performance thereof.

Accordingly, it is possible to increase the sound pressure level and offer the low-frequency-range expansion effect, and further to improve the quality and the reliability.

Figure 4:
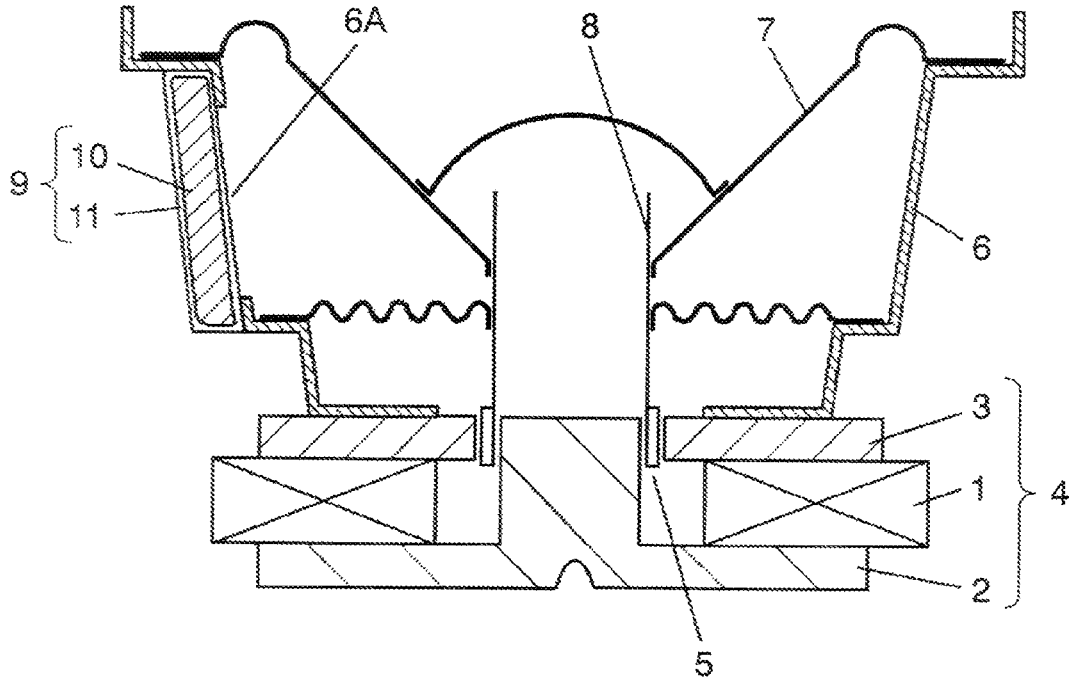
FIG. 4 is a cross-sectional view of a fourth exemplary speaker according to the first embodiment of the present invention.

FIG. 4 is a cross-sectional view of a fourth exemplary speaker according to the first embodiment of the present invention. The same components as those of FIGS. 1 to 3 are designated by the same reference numerals and will not be redundantly described.

As illustrated in FIG. 4, pressure adjusting body 9 can be coupled to air-flow hole 6A of frame 6.

In this case, pressure adjusting body 9 can be structured to be coupled such that it covers air-flow hole 6A of frame 6 from the outer side.

With this structure, it is possible to suppress, with pressure adjusting body 9, the distortion of air passing through air-flow hole 6A of frame 6. Further, this structure is significantly effective, since there is a large amount of air passing therethrough.

This can reduce the absorption of water such as humidity, thereby offering the effect of improving the quality and the reliability.

Further, although not illustrated, the frame may be provided with a housing portion for housing the pressure adjusting body, which can improve the reliability of coupling of the pressure adjusting body to the frame. Also, this can increase the production efficiency, during the process of coupling the pressure adjusting body to the frame, in the production of the speaker unit.

Further, the speaker unit can be used at the state where the frame is sealed to eliminate the communication with external air, which can suppress the absorption of water such as humidity, thereby further improving the quality and the reliability.

Also, the pressure adjusting body can be made of a fiber type activated carbon. This provides a large pressure-adjusting effect even with a smaller volume and, therefore, is significantly effective in the case of using a frame having a small capacity, a small-sized micro speaker or a small-sized receiver.

FIG. 5 illustrates an example where a pressure adjusting body made of a fiber-type activated carbon is used in a small-sized micro speaker or a small-sized receiver which is mounted to a cellular phone or the like.

Figure 5A:
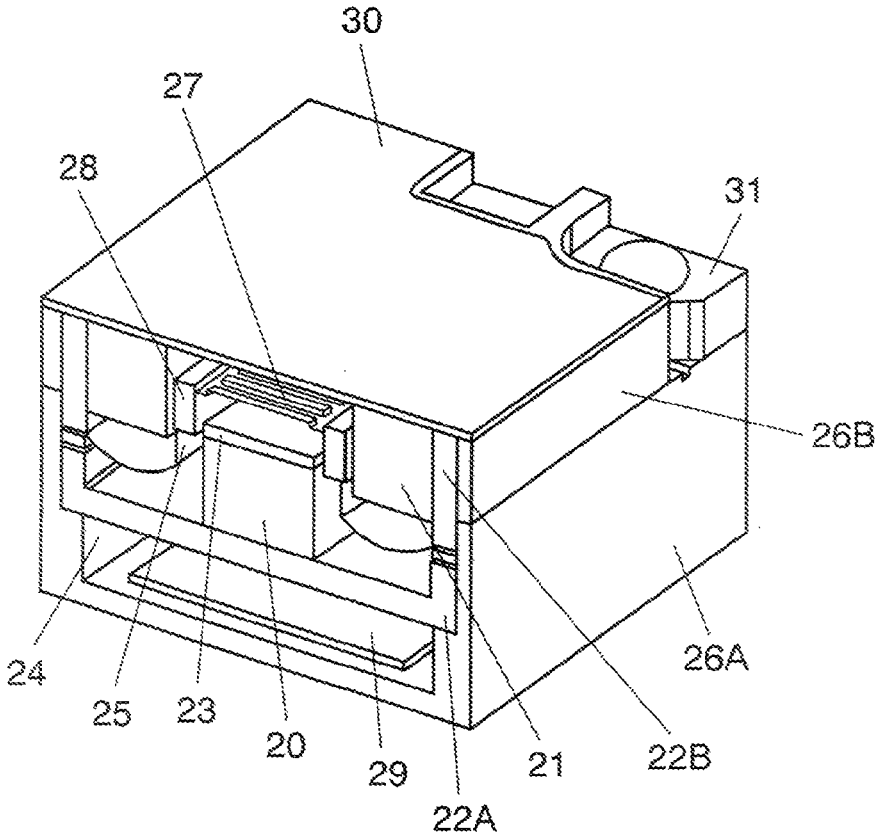
FIG. 5A is a perspective view of a small-sized rectangular-shaped speaker.
Figure 5B:
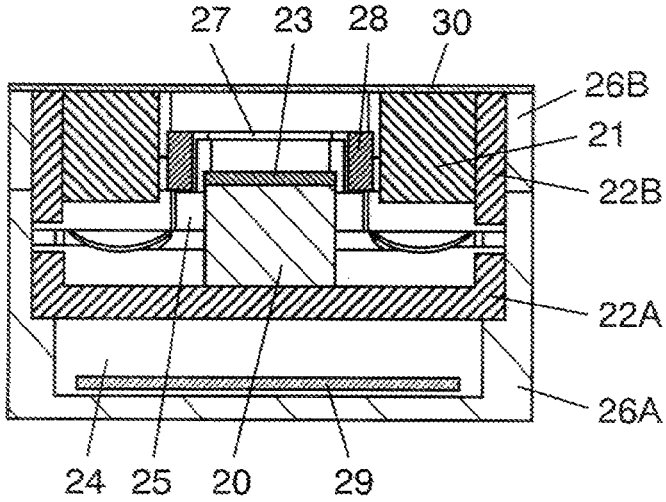
FIG. 5B is a cross-sectional view of the small-sized rectangular-shaped speaker.

FIG. 5A is a perspective view of a small-sized rectangular-shaped speaker, and FIG. 5B is a cross-sectional view of the same.

As illustrated in FIGS. 5A and 5B, the rectangular-shaped speaker includes lower magnet 20, upper magnet 21, lower yoke 22A coupled to lower magnet 20, upper yoke 22B coupled to upper magnet 21, plate 23 coupled to lower magnet 20, magnetic circuit 24, magnetic gap 25 defined by lower magnet 20 and upper magnet 21, lower frame 26A coupled to lower yoke 22A, upper frame 26B coupled to upper yoke 22B, vibration plate 27 coupled to lower yoke 22A and upper yoke 22B, voice coil 28 which is coupled to vibration plate 27 and placed in magnetic gap 25 in magnetic circuit 24, fiber-type activated carbon 29, protector 30 and terminal 31.

This rectangular-shaped speaker is structured to be effective increasing the space factor, to increase the sound pressure level and to improve the reproduction of bass sounds, with a reduced size and a reduced thickness. Namely, as previously described, this rectangular-shaped speaker includes two or more magnets (upper magnet 21 and lower magnet 20) for increasing the energy of magnetic circuit 24, and also has magnetic gap 25 defined by these magnets which are obliquely placed, thereby realizing reduction in the thickness and the size.

Further, the speaker has a rectangular outer shape for increasing the space factor and also employs angular-shaped magnetic-circuit components such as the magnets, plate 23 and the yokes (lower yoke 22A and upper yoke 22B) for effectively utilizing the space of the magnetic circuit and for increasing the efficiency of the space.

Further, lower frame 26A forms a sealed space, and also a pressure adjusting body made of fiber-type activated carbon 29 is placed inside thereof, which can increase the sound-pressure level and realize lower-frequency-range expansion. Further, the sealed spaced formed therein can suppress the absorption of water such as humidity and also can improve the quality and the reliability.

Further, in order to further reduce the size and to increase the space factor, it is possible to provide a hole for releasing sounds to the outside of the frame, at the center portion of upper frame 26B for example, at which upper magnet 21 does not exist near the end surface of the portion to which upper magnet 21 is coupled. This can further reduce the size and increase the space factor.

Further, terminal 31 can be placed using the space in upper frame 26B in which upper magnet 21 does not exist near the end surface of the portion to which upper magnet 21 is coupled, without protruding outward from the rectangular-shaped speaker when it is viewed in a horizontal plane. This can further reduce the size rind increase the space factor.

As described above, it is possible to realize size reduction and space-factor increase, even for a small-sized micro speaker or a small-sized receiver which is mounted to a cellular phone or the like. Currently, regarding the characteristics and the sound quality which have been sacrificed in general, it is possible to increase the sound pressure level and to improve the reproduction of bass sounds, by using the pressure adjusting body made of a fiber-type activated carbon or the like.

Further, by adjusting the pressure inside the sealed, space with a smaller capacity, it is possible to suppress the distortion.

(Second Embodiment)

Figure 6:
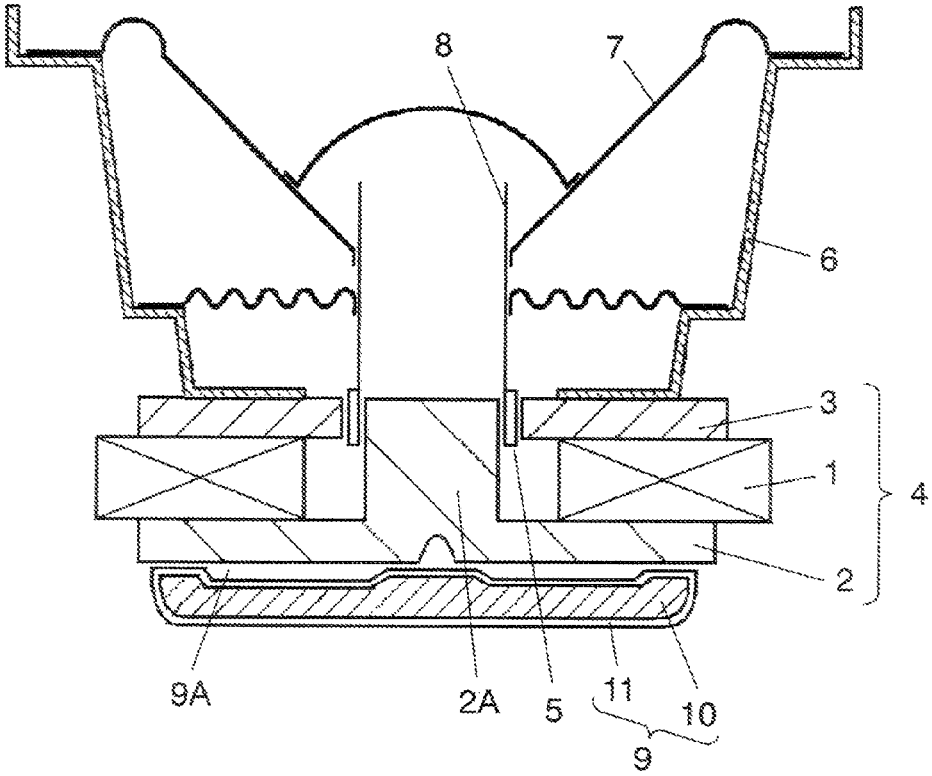
FIG. 6 is a cross-sectional view of a speaker according to a second embodiment of the present invention.

FIG. 6 illustrates a cross-sectional view of a speaker according to a second embodiment of the present invention. The same components as those of the first embodiment are designated by the same reference numerals and will not be described in detail.

As illustrated in FIG. 6, the speaker is constituted by magnetic circuit 4 which is constituted by lower plate 2 having center pole 2A, magnet 1 coupled to lower plate 2 and upper plate 8 coupled to magnet 1 at the side opposite from lower plate 2, frame 6 coupled to magnetic circuit 4, vibration plate 7 coupled to an outer peripheral portion of frame 6, voice coil 8 which is coupled to vibration plate 7 and also is partially placed within magnetic gap 5 in magnetic circuit 4, and pressure adjusting body 9 coupled to magnetic circuit 4. This speaker is also referred to as a speaker unit.

In this case, there is exemplified a case where pressure adjusting body is coupled to the back surface of lower plate 2.

With the above structure pressure adjusting body 9 is already coupled to the speaker unit, which can suppress the increase of extra cost along with the costs for physical distribution and coupling of pressure adjusting body 9 in fabricating the speaker device.

Further, since pressure adjusting body 9 is coupled to the speaker unit, pressure adjusting body 9 is placed inside or near the speaker unit, which enables reproduction of bass sounds efficiently and preferably, in comparison with the case where pressure adjusting body 9 is placed at a position remote from the speaker unit within the cabinet.

Further, pressure adjusting body 9 coupled to magnetic circuit 4 in the speaker unit, which is a heat-producing member. Accordingly, since pressure adjusting body 9, which is generally prone to degrade in the performance due to humidity, is coupled inside or near the speaker unit which is heated to a higher temperature, it is possible to suppress the absorption of humidity into pressure adjusting body 9, thereby preventing the degradation of the performance.

Therefore, according to the present invention, it is possible to realize preferable reproduction of bass sounds even with a small-sized speaker device, while suppressing the increase in the cost.

Further, it is possible to realize a countermeasure against the absorption of humidity into pressure adjusting body 9, thereby realizing improvement of the quality and reliability thereof.

In this case, pressure adjusting body 9 is constituted by pressure adjusting member 10 and housing portion 11 for housing pressure adjusting member 10, wherein activated carbon is used as pressure adjusting member 10.

Further, pressure adjusting member 10 can be made of any material which contains activated carbon as well as activated carbon, and such a material containing activated carbon enables realization of preferable reproduction of bass sounds.

Further, housing portion 11 can be made of a material having air permeability such as unwoven cloth, which enables preferable reproduction of bass sounds.

Further, magnetic circuit 4 and pressure adjusting body 9 are coupled to each other with gap 9A provided between their coupling surfaces. With this structure, it is possible to maintain a large surface area of pressure adjusting body 9 which contacts the air, thereby efficiently realizing the reproduction bas sounds.

On the other hand, when the speaker is expected to be used at a humid place, the housing portion 11 can be effectively made of a material having no air permeability, instead of a material having air permeability, in order to increase the quality and the reliability.

This is for preventing the reduction of the low-frequency-range expansion effect due to the intrusion of water into fine holes of pressure adjusting member 10 typified by activated carbon.

Figure 7:
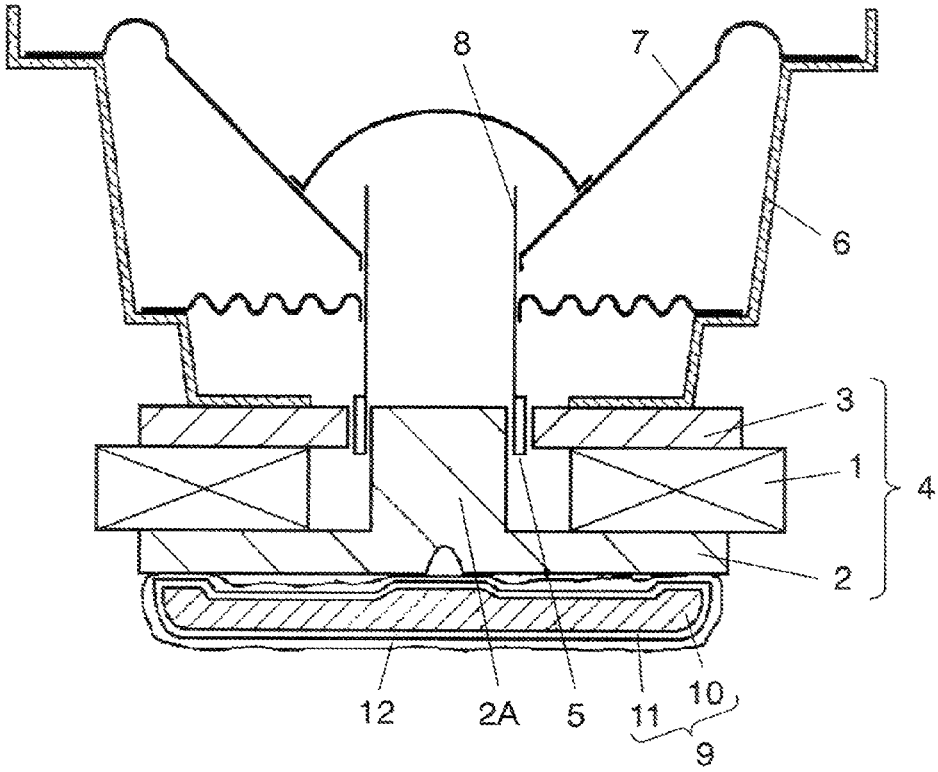
FIG. 7 is a cross-sectional view of a second exemplary speaker according to the second embodiment of the present invention.

FIG. 7 is a cross-sectional view of a second exemplary speaker according to the second embodiment of the present invention. The same components as those of FIG. 6 are designated by the same reference numerals and will not be redundantly described.

As illustrated in FIG. 7, pressure adjusting body 9 can be structured to be covered with sealing case 12 having high flexibility. This is also effective to prevent the reduction of the lower-frequency-range expansion effect due to the intrusion of water into the fine holes of pressure adjusting member 10.

Next, there will be described the portion for coupling pressure adjusting body 9.

While there has been described an embodiment in which pressure adjusting body 9 is coupled to the back surface of lower plate 2, the present invention is not limited to this embodiment, and there is no limitation on the portion to which pressure adjusting body 9 is coupled, provided that pressure adjusting body is coupled to magnetic circuit 4.

Figure 8:
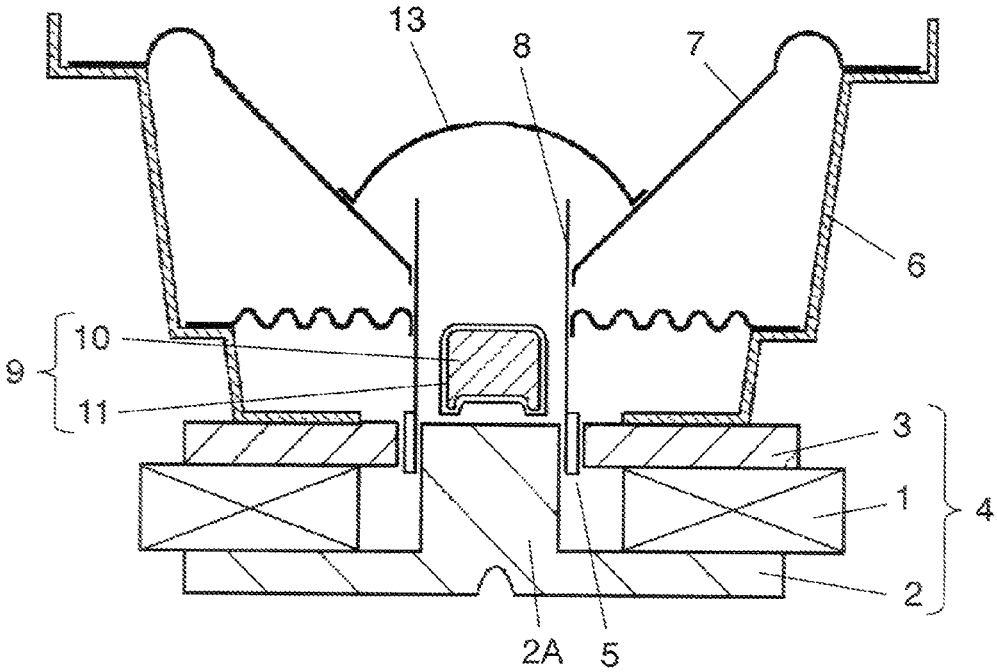
FIG. 8 is a cross-sectional view of a third exemplary speaker according to the second embodiment of the present invention.

FIG. 8 is a cross-sectional view of a third exemplary speaker according to the second embodiment of the present invention. The same components as those of FIGS. 6 and 7 are designated by the same reference numerals and will not be redundantly described.

As illustrated in FIG. 8 pressure adjusting body 9 can be coupled to center pole 2A of lower plate 2.

With this structure, it is possible to offer the same effects as those which could be offered by substantially increasing the capacity of the space surrounded by center pole 2A of lower plate 2, voice coil 8, vibration plate 7 and dust cap 13 within the speaker.

Accordingly, it is possible to offer the effect of reducing the distortion in addition to a low-frequency-range expansion effect, thereby realizing preferable sound quality.

Figure 9:
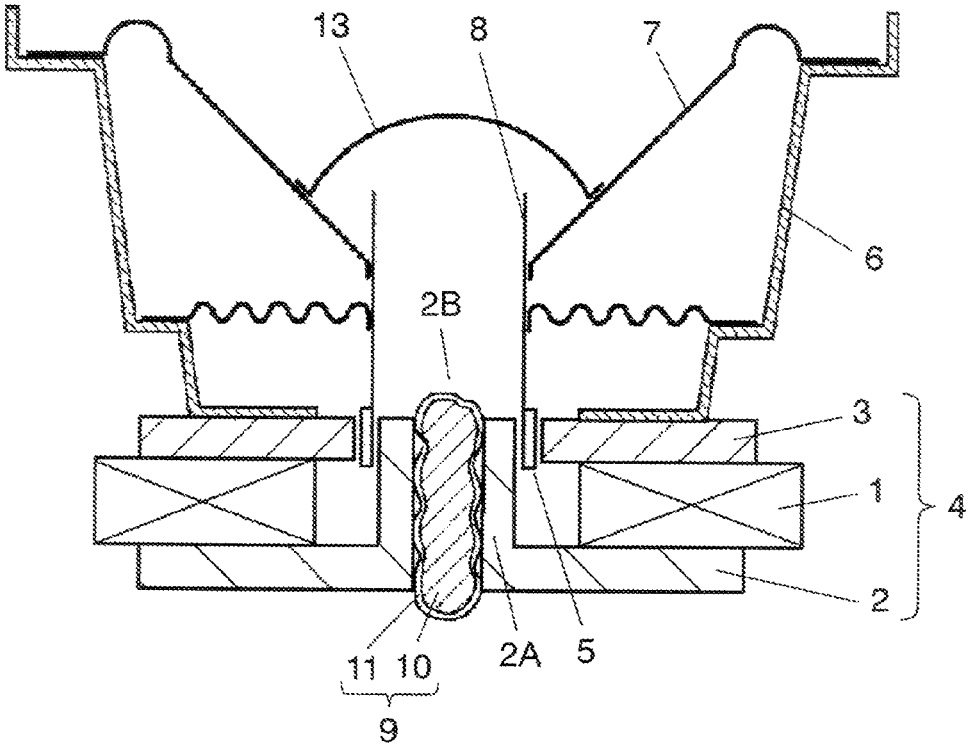
FIG. 9 is a cross-sectional view of a fourth exemplary speaker according to the second embodiment of the present invention.

FIG. 9 is a cross-sectional view of a fourth exemplary speaker according to the second embodiment of the present invention. The same components as those of FIGS. 6 to 8 are designated by the same reference numerals and will not be redundantly described.

As illustrated in FIG. 9, pressure adjusting body 9 can be placed in hole 2B provided in center pole 2A of lower plate 2.

In the case of providing hole 2B in center pole 2A as in this structure, it is possible to release air within the space surrounded by center pole 2A in lower plate 2, voice coil 8, vibration plate 7 and dust cap 13 within the speaker to the outside, thereby offering a low-frequency-range expansion effect and a distortion reduction effect.

By placing pressure adjusting body 9 in hole 2B provided in center pole 2A, it is possible to enhance these effects, thereby realizing preferable sound quality.

Namely, it is possible to reduce the distortion of air passing through the hole 2B provided in center pole 2A with pressure adjusting body 9 and also it is possible to offer the effect of increasing the capacity within the cabinet both inside and outside the speaker. This is significantly effective.

Further, by placing pressure adjusting body 9 in hole 2B provided in center pole 2A, it is possible to suppress the absorption of water such as humidity into pressure adjusting body 9 and also to offer the effect of improving the quality and the reliability, since a large amount of air can pass therethrough and pressure adjusting body 9 is in contact with the magnetic circuit which is heated to a higher temperature during the operation of the speaker.

Figure 10:
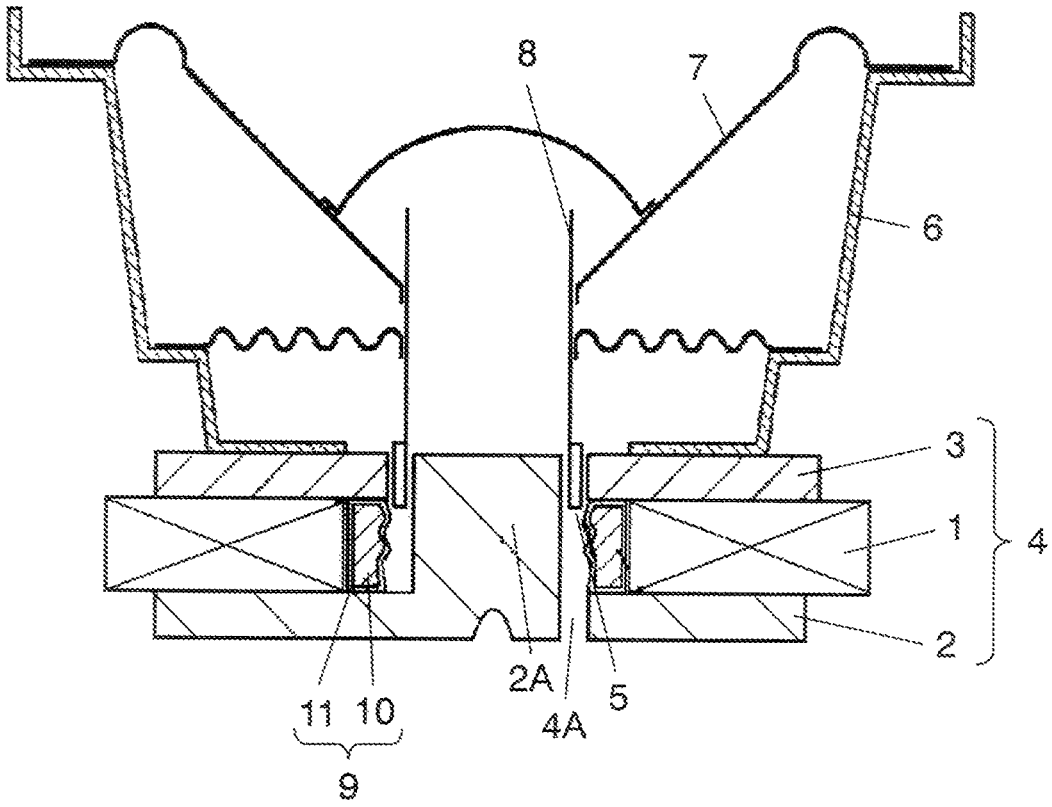
FIG. 10 is a cross-sectional view of a fifth exemplary speaker according to the second embodiment of the present invention.

FIG. 10 is a cross-sectional view of a fifth exemplar speaker according to the second embodiment of the present invention. The same components as those of FIGS. 6 to 9 are designated by the same reference numerals and will not be redundantly described.

As illustrated in FIG. 10, pressure adjusting body 9 can be coupled to an inner peripheral portion of magnet 1, which can increase the space factor, since it is coupled to a space portion which is usually a dead space.

In this case, hole 4A can be provided at a portion of magnetic circuit 4, such as in lower plate 2 or upper plate 3, in order to allow direct communication of air with pressure adjusting body 9 provided at the inner peripheral portion of the magnet. This can further enhance the low-frequency-range expansion effect and the distortion reduction effect.

(Third Embodiment)

Figure 11:
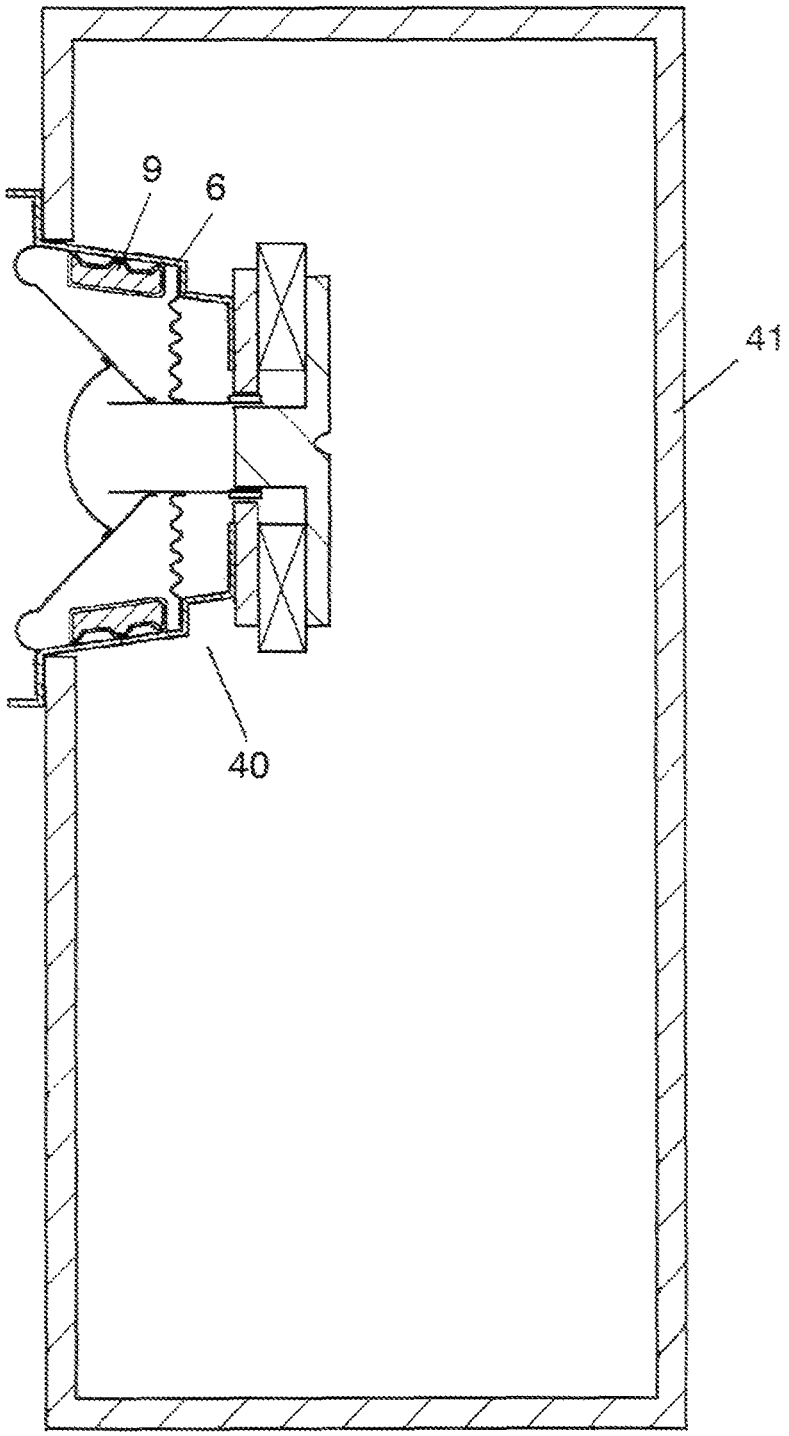
FIG. 11 is a cross-sectional view of a speaker device according to a third embodiment of the present invention.

FIG. 11 is a cross-sectional view of a speaker device according to a third embodiment of the present invention. The same components as those of the first and second embodiments are designated by the same reference numerals and will not be described in detail.

As illustrated in FIG. 11, the speaker device is constituted by a magnetic circuit, frame 6 coupled to the magnetic circuit, a vibration plate coupled to an outer peripheral portion of frame 6, a voice coil which is coupled to the vibration plate and is partially placed in a magnetic gap in the magnetic circuit, speaker 40 including pressure adjusting body 9 coupled to frame 6 as described in the first embodiment, and cabinet 41 in which speaker 40 is mounted.

With this structure, it is possible to provide a speaker device including pressure adjusting body 9 provided within cabinet 41, only by mounting, to cabinet 41, speaker 40 to which pressure adjusting body 9 has been preliminarily coupled.

This can eliminate the necessity of individually mounting the speaker and the pressure adjusting body to the cabinet as in the conventional device, which can reduce the cost for physical distribution of the pressure adjusting body and the cost for mounting the pressure adjusting body to the cabinet, thereby enabling significant cost reduction.

Furthermore, it is possible to offer the various effects which have been described in the first embodiment.

Figure 12:
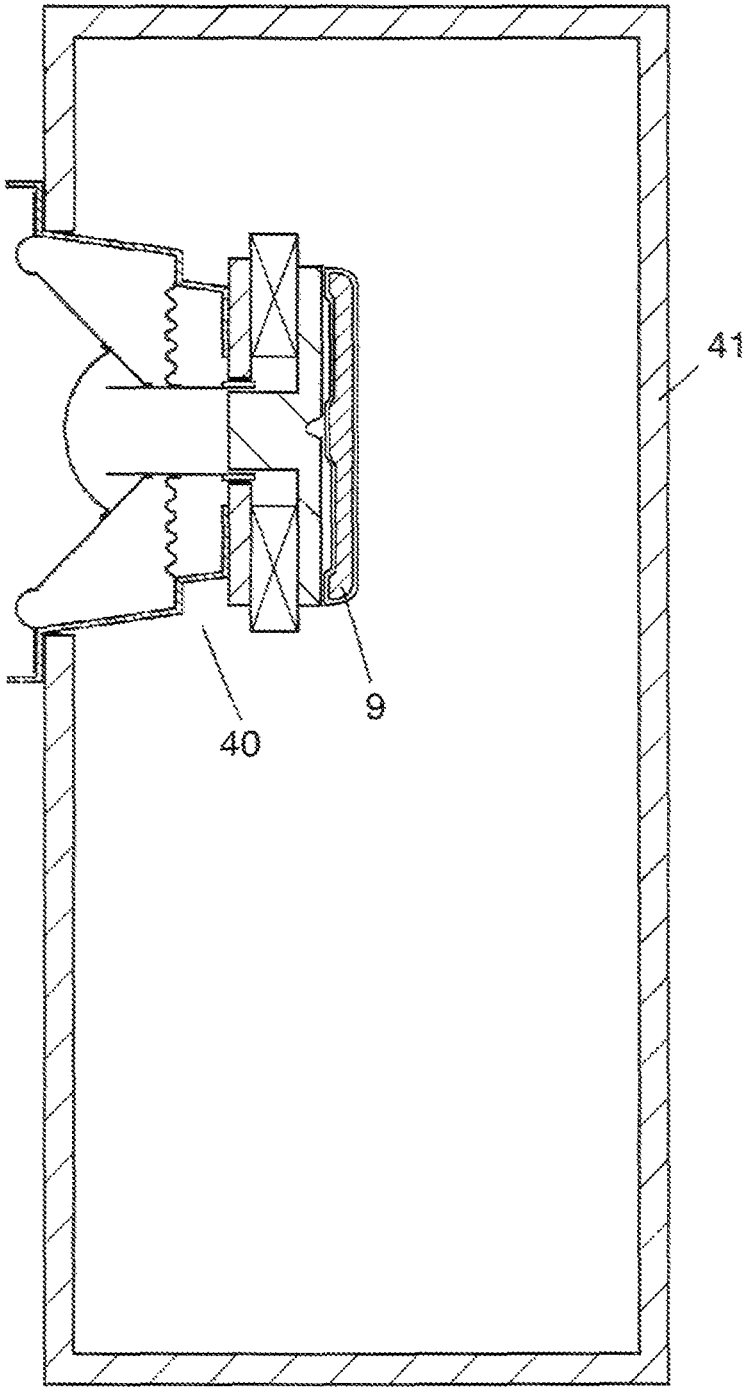
FIG. 12 is a cross-sectional view of a second exemplary speaker device according to the third embodiment of the present invention.

FIG. 12 illustrates a cross-sectional view of a second exemplary speaker device according to the third embodiment of the present invention.

As illustrated, in FIG. 12, it is also possible to mount, to cabinet 41, speaker 40 including pressure adjusting body 9 which has been described in the second embodiment of the present invention (a speaker including a magnetic circuit and a pressure adjusting body coupled thereto) to form the speaker device. This can also offer the same effects and also can offer the effects which have been described in the second embodiment.

Further, FIG. 11 illustrates an example where the speaker illustrated in FIG. 1 is mounted, while FIG. 12 illustrates an example where the speaker illustrated in FIG. 6 is mounted. However, the present invention is not limited to these speakers, but any of the speakers illustrated in FIGS. 1 to 4 and FIGS. 6 to 10 can be mounted.

(Fourth Embodiment)

Figure 13A:
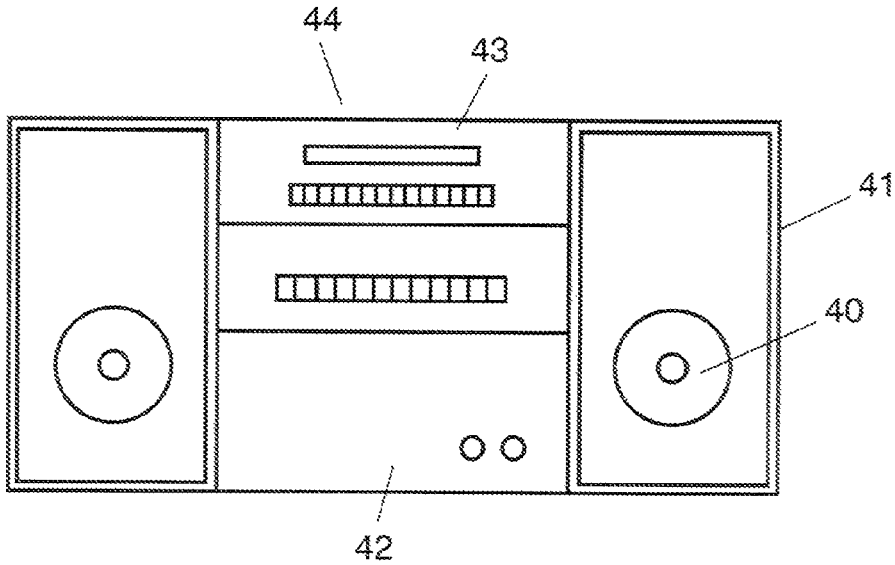
FIG. 13A is an external view of an electronic apparatus according to a fourth embodiment of the present invention.

FIG. 13A is an external view of an electronic apparatus according to a fourth embodiment a the present invention.

In the fourth embodiment a speaker as described in any of the first and second embodiments is mounted to constitute an audio mini composite system as an electronic apparatus.

As illustrated in FIG. 7A, speaker 40 described in any of the first and second embodiments is incorporated in cabinet 41 to form a speaker device, and also amplifier 42 as means for amplifying electric signals to be inputted to the speaker and player 43 for outputting sources to be inputted to the amplifier are provided to constitute audio mini composite system 44 as an electronic apparatus.

With this structure, it is possible to realize preferable reproduction of bass sounds, while realizing s reduction and compaction of the electronic apparatus.

Further, while in the present embodiment, there has been described a case where the speaker according to the present invention is mounted to an audio mini composite system as an electronic apparatus, the present invention is not limited thereto, and the speaker according to the present invention can be mounted to a video apparatus such as a television or in a movable communication apparatus. Namely, the present invention is applicable to any electronic apparatus incorporating a speaker.

Particularly, there has been a demanding requirement in the market for reduction of the sizes and thicknesses of video apparatuses such as televisions, which have been rapidly advanced from Braun tubes to liquid crystal displays and plasma displays, recently. Accordingly, it will be particularly effective to mount the speaker according to the present invention to the video apparatuses in the future.

Figure 13B:
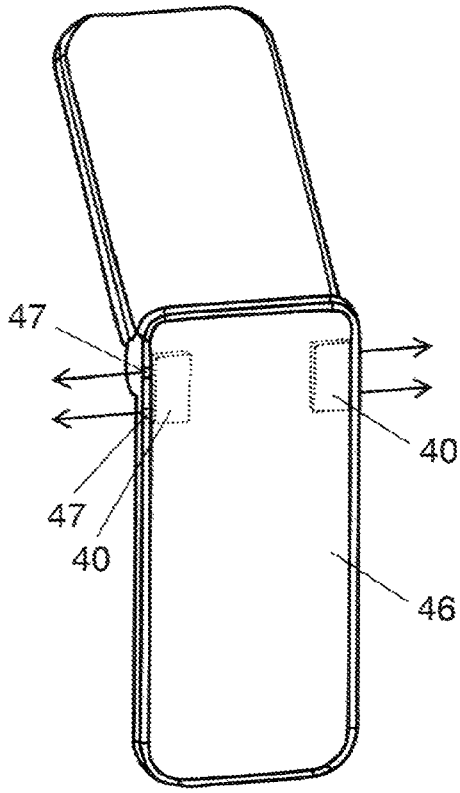
FIG. 13B is an external view of a second exemplary electronic apparatus according to the fourth embodiment of the present invention.

FIG. 13B is an external view of a second exemplary electronic apparatus according to the fourth embodiment of the present invention.

In the present embodiment, a small-sized rectangular-shaped speaker as described in the first embodiment is mounted to constitute a cellular phone as an electronic apparatus.

As illustrated in FIG. 13B, speaker 40 according to the present invention is mounted inside of the cellular phone, and the sound-releasing hole provided in the frame in speaker 40 described in the first embodiment is communicated with sound-releasing hole 47 provided in the outer side of cellular-phone main body 46.

With this structure, it is possible to reduce the acoustic resistance for releasing sounds in the lateral direction of cellular-phone main body 46. This can increase the sound pressure level and can realize preferable reproduction of bass sounds, while realizing thickness reduction, size reduction and compaction of the cellular phone.

(Fifth Embodiment)

Figure 14:
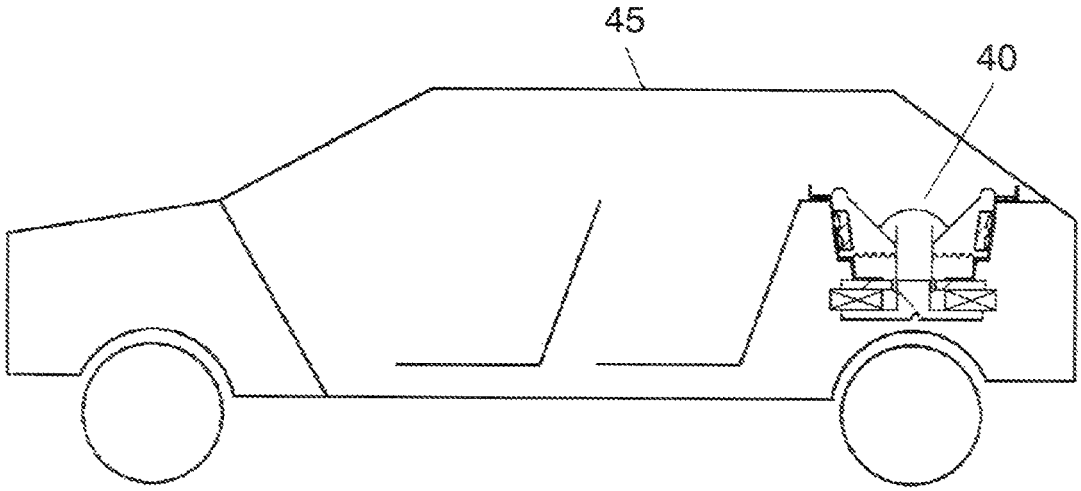
FIG. 14 is a cross-sectional view of an automobile according to a fifth embodiment of the present invention.
Figure 15:
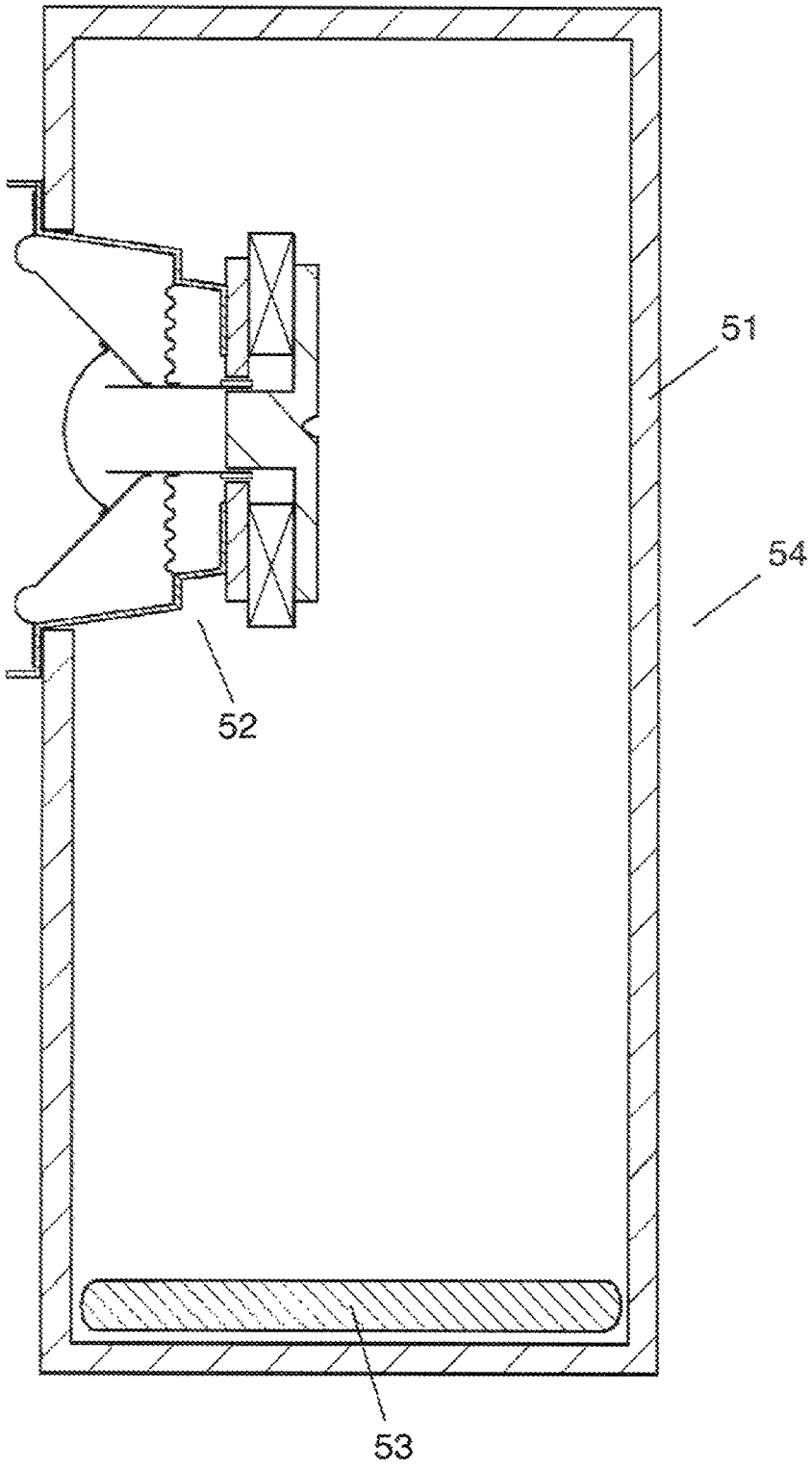
FIG. 15 is a cross-sectional view of a conventional speaker device.

FIG. 14 is a cross-sectional view of an automobile as a vehicle according to a fifth embodiment of the present invention.

In the fifth embodiment, is speaker as described in any of the first and second embodiments is mounted to constitute an automobile as a vehicle.

Namely, speaker 40 is mounted to the rear tray of automobile 45.

With this structure, it is possible to realize preferable reproduction of bass sounds, while realizing size reduction and compaction of automobile 45 as a vehicle.

Further, the portion of automobile 45 to which the speaker is mounted is not limited to the rear tray, but can be any portion such as a door, the ceiling, a pillar, the floor, the instrumental panel, or a sheet.

Further, FIG. 14 illustrates an example where the speaker illustrated in FIG. 1 is mounted. However, the present invention is not limited to the speaker, but any of the speakers illustrated in FIGS. 1 to 4 and FIGS. 6 to 10 can be mounted.

Further, while in the present embodiment, there has been described a case where the speaker is mounted in an automobile as a vehicle, the present invention is not limited thereto, and the present invention is applicable to a movable apparatus such as a train or a ship or in a construction such as a house. Namely, the present invention is applicable to anything capable of incorporating a speaker.

Industrial Applicability

The speaker, the speaker device, the electronic apparatus and the vehicle according to the present invention are applicable to audio/visual equipment electronic apparatuses such as information communication apparatuses and vehicles such as automobiles which are required to realize preferable reproduction of bass sounds, as well as to have reduced sizes and compact shapes.

The invention claimed is:

1. A speaker comprising a magnetic circuit, a frame coupled to the magnetic circuit a vibration plate coupled to an outer peripheral portion of the frame, a voice coil which is coupled to the vibration plate and is partially placed in a magnetic gap in the magnetic circuit, and a pressure adjusting body coupled to the magnetic circuit, wherein the pressure adjusting body contains activated carbon and is not disposed between the magnetic circuit and the vibration plate.

2. The speaker according to claim 1, wherein the pressure adjusting body includes a pressure adjusting member and a housing portion for housing the pressure adjusting member.

3. The speaker according to claim 1, wherein the pressure adjusting body includes a pressure adjusting member and a housing portion for housing the pressure adjusting member, and the pressure adjusting member is made of activated carbon or a material containing activated carbon.

4. The speaker according to claim 1, wherein the pressure adjusting body includes a pressure adjusting member and a housing portion for housing the pressure adjusting member, and the housing portion has air permeability.

5. The speaker according to claim 1, wherein the pressure adjusting body includes a pressure adjusting member and a housing portion for housing the pressure adjusting member and the housing portion is made of an unwoven cloth.

6. The speaker according to claim 1, wherein the magnetic circuit and the pressure adjusting body are coupled to each other with a gap provided between their coupling surfaces.

7. The speaker according to claim 1, wherein the pressure adjusting body includes a pressure adjusting member and a housing portion for housing the pressure adjusting member, and the housing portion has no air permeability.

8. The speaker according to claim 1, wherein the pressure adjusting body is further covered with a sealing case having flexibility.

9. The speaker according to claim 1, wherein the pressure adjusting body is made of a fiber-type activated carbon.

10. The speaker according to claim 1, wherein the magnetic circuit includes a lower plate having a center pole, a magnet coupled to the lower plate and an upper plate coupled to the magnet at the side opposite from the lower plate, and the pressure adjusting body is coupled to the back surface of the lower plate.

11. The speaker according to claim 1, wherein the magnetic circuit includes a lower plate having a center pole, a magnet coupled to the lower plate and an upper plate coupled to the magnet at the side opposite from the lower plate, and the pressure adjusting body is coupled to the center pole of the lower plate.

12. The speaker according to claim 1, wherein the magnetic circuit includes a lower plate having a center pole, a magnet coupled to the lower plate and an upper plate coupled to the magnet at the side opposite from the lower plate, and the pressure adjusting body is placed in a hole provided in the center pole of the lower plate.

13. The speaker according to claim 1, wherein the magnetic circuit includes a lower plate having a center pole, a magnet coupled to the lower plate and an upper plate coupled to the magnet at the side opposite from the lower plate, and the pressure adjusting body is coupled to an inner peripheral portion of the magnet.

14. A speaker device comprising the speaker according to claim 1 and a cabinet to which the speaker is mounted.

15. An electronic apparatus incorporating the speaker according to claim 1.

16. A vehicle incorporating the speaker according to claim 1.

17. The speaker according to claim 1, wherein the magnetic circuit is a heat-producing member, and a temperature rise of the magnetic circuit suppresses absorption of humidity into the activated carbon contained by the pressure adjusting body.

18. The speaker according to claim 1, wherein the pressure adjusting body absorbs or releases air molecules along with pressure change.

19. The speaker according to claim 14, wherein the pressure adjusting body absorbs or releases air molecules along with pressure change and the cabinet operates equivalently to a cabinet having a large capacity.

* * * * *

UNITED STATES PATENT AND TRADEMARK OFFICE

CERTIFICATE OF CORRECTION

PATENT NO. : 8,553,924 B2
APPLICATION NO. : 11/816174
DATED : October 8, 2013
INVENTOR(S) : Sumiyama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 625 days.

Signed and Sealed this
Fifteenth Day of September, 2015

Michelle K. Lee

Michelle K. Lee
*Director of the United States Patent and Trademark Office*